United States Patent [19]

Kraverath

[11] Patent Number: 4,882,789

[45] Date of Patent: Nov. 28, 1989

[54] TRAP PRIMER TAIL PIECE

[76] Inventor: Robert Kraverath, 1311 SW. 83rd Ave., No. Lauderdale, Fla. 33068

[21] Appl. No.: 735,282

[22] Filed: May 15, 1985

Related U.S. Application Data

[63] Continuation-in-part of Ser. No. 525,692, Aug. 23, 1983, abandoned.

[51] Int. Cl.[4] ..... E03C 1/24

[52] U.S. Cl. ..... 4/191; 4/661

[58] Field of Search ..... 4/191, 661; 285/150, 285/155; 137/247.25

[56] References Cited

U.S. PATENT DOCUMENTS

| | | | |
|---|---|---|---|
| 2,065,789 | 12/1936 | Bolsinger | 285/150 X |
| 2,162,236 | 6/1939 | Williams | 182/12 |
| 2,233,818 | 3/1941 | Matter | 137/34.2 |
| 2,929,566 | 3/1960 | Paasche | 285/150 X |
| 2,938,530 | 5/1960 | Matter | 137/115 |
| 3,134,392 | 5/1964 | Goss | 137/118 |
| 3,333,597 | 8/1967 | Sullivan | 137/247.25 |
| 4,000,752 | 1/1977 | Miller | 137/118 |
| 4,162,546 | 7/1979 | Shortell | 4/191 |
| 4,179,762 | 12/1979 | Barnhardt et al. | 4/191 |
| 4,204,556 | 5/1980 | Sullivan | 137/206 |
| 4,218,786 | 8/1980 | Taglarino . | |

FOREIGN PATENT DOCUMENTS

| | | | |
|---|---|---|---|
| 103618 | 3/1964 | Norway | 285/155 |
| 576406 | 4/1935 | United Kingdom | 285/155 |

*Primary Examiner*—Charles E. Phillips

*Attorney, Agent, or Firm*—Malin, Haley & McHalew

[57] ABSTRACT

Disclosed is a primer for charging and replenishing conventional water traps, such traps being required by most building codes. The primer is a section of pipe inserted in the drainpipe of a water user station (e.g. sink or washing machine), and has a tap or bleed line that diverts a portion of all drain water to the water trap. The bleed line can have a screen across it to filter out solid particulates that might otherwise clog the trap, and the bleed line can also have a lip or spoon that extends toward the center of the main drainpipe to facilitate the diversion of water. Having no moving parts, the primer is especially reliable, and can be inexpensively manufactured. Using only drainwater, rather than feedwater from the cold tap, as is done conventionally, the primer conserves water.

3 Claims, 1 Drawing Sheet

TRAP PRIMER TAIL PIECE

This is a continuation-in-part of application Ser. No. 525,692, filed 8/23/83, now abandoned.

BACKGROUND OF THE INVENTION

Virtually all building codes require that drain pipes from sinks, washing machines, and like user stations have water traps, the purpose of which is to prevent unsanitary and unpleasant sewer gases from entering buildings via the drainpipes. These traps work by trapping within a section of drainpipe an amount of water that provides a liquid seal separating sink and sewer. Because this barrier can evaporate or freeze, particularly if a user station is rarely used, such traps are conventionally accompanied by primers that bleed off water from, typically, a cold water supply line to replenish the water barrier. Such a scheme inherently wastes water, and does nothinng to prevent the water seal from freezing because these traps are fed with cold water. In order to minimize waste, prior primers typically have complex valving schemes, for example valves that open upon flow beginning in the feed line, but close upon flow exceeding a predetermined value. These primers are thus complicated devices given to periodic failure, and require periodic maintenance or replacement.

SUMMARY OF THE INVENTION

Accordingly, it is an object of the invention to provide a trap primer that does not waste supply water, and, because the trap primer may utilize hot water as well as cold, will prevent trap seal freezing.

It is another object of the invention to provide a trap primer that is simple and inexpensive to manufacture, having no moving parts.

It is another object of the invention to provide a trap primer that is easily installed, highly reliable, and easily maintained.

In accordance with these and other objects that will be apparent hereinafter, there is provided a primer trap located in the drainage line, rather than the water supply line, thus using drain water rather than supply water to charge the water seal. The primer is a section of the drainpipe that has an additional bleed pipe for diverting a portion of the water flowing in the drainpipe to the trap. The bleed pipe can have a screen to filter solid particulates, and the juncture of the drainpipe and bleed pipe can have a removable fitting to facilitate cleaning the screen. This juncture can also be provided with a lip, or spoon, to aid in diverting water into the bleed-pipe.

The instant invention will be more fully understood from the following detailed description, it being understood, however, that the invention is capable of extended application, and is not confined to the precise disclosure. Suggested changes and modifications may be made that do not affect the spirit of the invention nor exceed the scope thereof as expressed in the appended claims. Accordingly, the instant invention will now be described with particular reference to the accompanying drawings.

DETAILED DESCRIPTION OF THE PREFERRED EMBODIMENT

Figure 1:
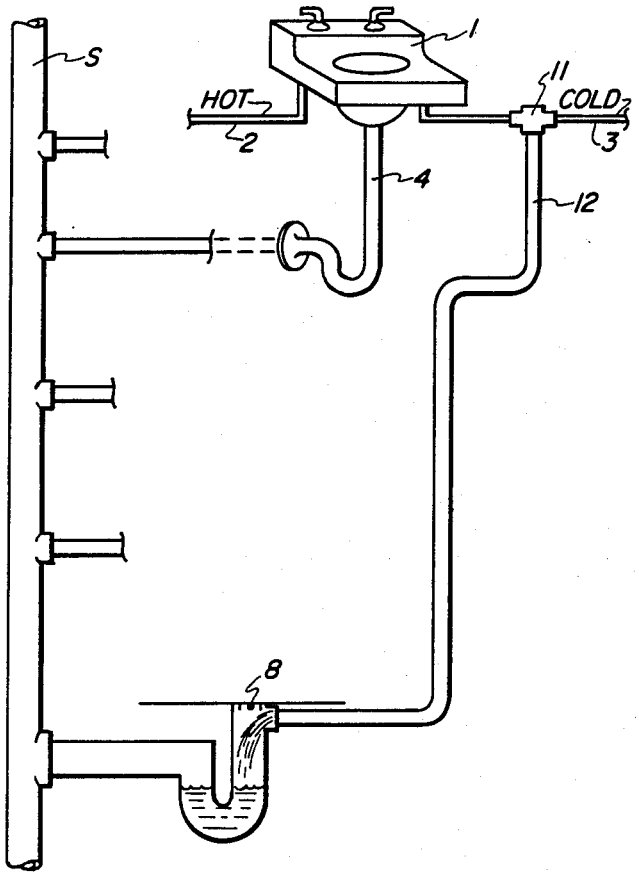
FIG. 1 (PRIOR ART)
FIG. 1 shows a conventional plumbing system having a prior trap primer.

FIG. 1 shows a typical prior art sink or lavatory 1 and drain system therefor. The hot water supply line is at 2, the cold line at 3. Drainage from sink 1 enters drain pipe 4, and ultimately empties into larger drainage line 5, which typically would carry the drainage from several sinks or lavatories to a sewer. In floor below sink 1 is floor drain 8, having a water seal 6, here illustrated as a conventional P-trap having bend 10. Trap 6 is designed to isolate downstream portion 7 of pipe 5 from upstream portion 8 by holding water 9. A trap primer 11 diverts water from cold water line 3 into primer line 12, and delivers the directed flow to trap 6, replenishing the water 9 in bend 10 of trap 6. Such prior primers typically have a complicated valving scheme that initiate water diversion when water begins to flow in line 3, but stops the diversion if the flow in line 3 exceeds a certain value.

Figure 2:
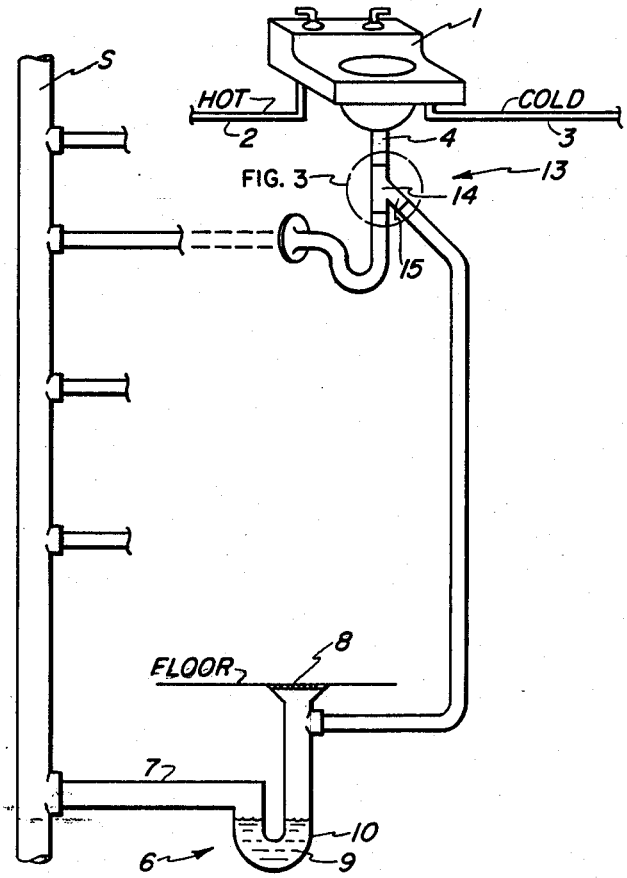
FIG. 2 shows the same plumbing system, but with the trap primer of the instant invention.

FIG. 2 is similar to FIG. 1, identical components being indicated by the identical numbers, but shows the trap primer or trap primer tail piece or tail piece, of the instant invention. Primer 13 is a section of drain pipe 4 vertically mounted and located below sink 1. Extending out of primer 13 is a bleed pipe at an angle to vertical advantageously between 30 degrees and 60 degrees.

Figure 3:
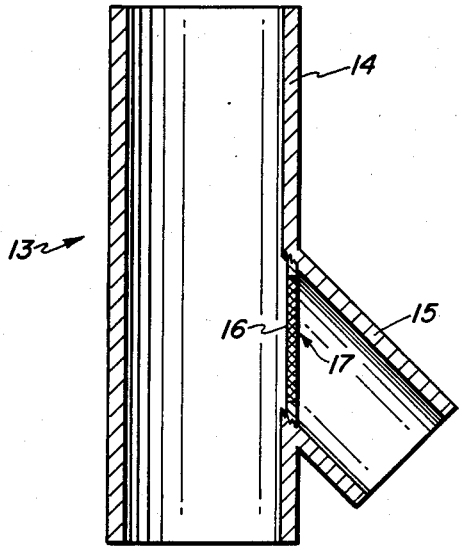
FIG. 3 is a cross-sectional view of the trap primer of the instant invention, the section taken from FIG. 2 as illustrated.

In FIG. 3, primer 13 is seen to have a first pipe section main portion or tail piece or main tail piece means 14, and a bleed pipe section or branch portion or branch means 15. Water entering pipe 14 typically will be turbulent and splattering, bouncing off the inner wall of 14, and it is this turbulence that causes water to enter bleed pipe 15. For example, this turbulence can be caused by filter inserts placed in, e.g., kitchen sinks to catch food particulates and other solids. An interface or interface means lies between main portion 14 and branch portion 15 as shown in FIG. 3. The interface is at the intersection of the conduit in the main portion 14 and the conduit in branch portion 15. The intersection is a circular line as shown in FIG. 3.

If the water in drain pipe 14 will likely carry solid particulates (e.g. food or hair), a screen 16 can be placed across opening 17 between pipes 14, 15 to catch these particulates, so that trap 6 will not become clogged.

Pipe 14, 15 can be of unitary construction, or bleed pipe 15 can be detachable to facilitate assembly or the cleaning of screen 16, as is shown in FIG. 3, which shows pipes 14, 15 having complimentary screw threads. Threads are depicted for illustrative purposes; one can use any suitable detachable fitting.

Figure 4:
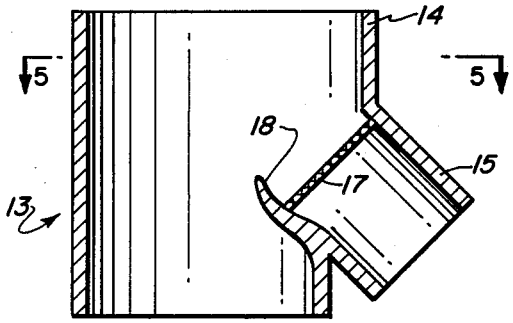
FIG. 4 is a view similar to that of FIG. 3, but showing a different embodiment of the invention.
Figure 5:
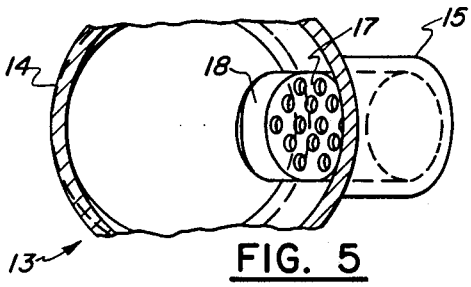
FIG. 5 is a cross-sectional view taken along 5—5 of FIG. 4.

The primer of FIG. 3 operates best if the water flowing in pipe 14 is turbulent, as discussed above. If one expects this water not to be thus, one can advantageously employ the embodiment of FIGS. 4–5. Here, a lip or spoon 18 is placed at the bottom of opening 17 to catch water flowing down the center of pipe 14 and divert it, as is done in a coal chute, to bleed pipe 15.

Although the invention is here described by several embodiments, this division is for illustrative purposes only. In particular, one can certainly use structure from one embodiment advantageously with that of another, for example the screen of FIG. 3 and the lip of FIG. 4. More generally the instant invention has been shown and described herein in what is considered to be the most practical and preferred embodiment. It is recognized, however, that departures may be made therefrom within the scope of the invention and that obvious modifications may occur to a person skilled in the art.

What is claimed is:

1. A plumbing system comprising a water supply means, a user station means for using the water supply, a first pipe means for delivering the water supply to the user station, second pipe means for draining water from the user station means, a water trap means for providing a water seal, and a primer means for delivery of water for the water seal to the water trap means, the primer means being located in the second pipe means downstream of the user station;

wherein the primer means comprises a first pipe section of the second pipe means for carrying a drain water flow, the primer means further comprising a bleed pipe section means for diverting water flowing in the first pipe section to the bleed pipe section means, the first pipe section and the bleed pipe section means being joined into a unitary member, there being an opening means for fluid communication between the interiors of the first pipe section and the bleed pipe section means where the first pipe section and the bleed pipe section means join, the bleed pipe section means being disposed at a downward angle to the horizontal along the entire vertical length of the bleed pipe section means, whereby to cause the flow of water in the bleed pipe section means to flow downhill;

wherein the means for diverting is effective to divert continuously a portion of the drain water flow into the bleed pipe section means as the flow of water passes the opening means while the flow of water travels downhill under gravity.

2. The primer of claim 1, wherein the primer means comprises a baffle means upstream of the opening means, the baffle means being effective to cause said flow to be turbulent and splashing off the interior walls of the first pipe section as the flow passes the opening while flowing downhill under gravity.

3. The primer of claim 1, wherein the means for diverting comprises a tongue means attached to the opening means and extending into the flow of drain water, the tongue means being disposed to continuously divert said portion of water into the bleed pipe section by deflecting and channeling said portion as the flow of drain water passes the opening means while flowing downhill under gravity.

* * * * *